US011401089B2

(12) United States Patent
Hughes et al.

(10) Patent No.: US 11,401,089 B2
(45) Date of Patent: Aug. 2, 2022

(54) DEVICE FOR AND METHOD OF SECURING A LID TO A FOOD CONTAINER

(71) Applicants: Armanda Hughes, Garden City, NY (US); Cameron Hughes, New York, NY (US)

(72) Inventors: Armanda Hughes, Garden City, NY (US); Cameron Hughes, New York, NY (US)

( * ) Notice: Subject to any disclaimer, the term of this patent is extended or adjusted under 35 U.S.C. 154(b) by 518 days.

(21) Appl. No.: 16/372,470

(22) Filed: Apr. 2, 2019

(65) Prior Publication Data

US 2019/0315539 A1 Oct. 17, 2019

Related U.S. Application Data

(60) Provisional application No. 62/658,018, filed on Apr. 16, 2018.

(51) Int. Cl.
*B65D 63/16* (2006.01)
*B65D 63/10* (2006.01)

(52) U.S. Cl.
CPC ..... *B65D 63/16* (2013.01); *B65D 63/109* (2013.01); *B65D 2563/101* (2013.01)

(58) Field of Classification Search
CPC ..... B65D 63/16; B65D 63/109; B65D 63/00; B65D 63/10; B65D 63/12; B65D 63/18; B65D 63/1018; B65D 2563/101; B65D 45/00; B65D 45/02; B65D 45/16; B65D 45/22; B65D 45/28; B65D 51/242; B65D 51/26; B65D 55/02; B65D 55/16; B65D 67/02; B65D 2555/02; A47J 36/10; A47J 36/06
USPC ..... 220/315, 912; 292/288
See application file for complete search history.

(56) References Cited

U.S. PATENT DOCUMENTS

| | | | | |
|---|---|---|---|---|
| 1,438,706 | A * | 12/1922 | Hegenberg | A47J 36/10 292/258 |
| 3,291,515 | A * | 12/1966 | Lierman | B65D 45/02 292/288 |
| 3,363,924 | A * | 1/1968 | Remig | B65F 1/1615 220/323 |
| 7,103,944 | B2 * | 9/2006 | Johnson | A47J 36/06 220/315 |
| 7,140,506 | B1 * | 11/2006 | Brady | A47J 36/10 220/756 |
| 9,635,976 | B1 * | 5/2017 | Charles | A47J 36/10 |
| 2002/0153378 | A1 * | 10/2002 | Bianco | B65D 45/00 220/315 |
| 2003/0132639 | A1 * | 7/2003 | Franklin | E05B 17/005 292/288 |
| 2008/0041857 | A1 * | 2/2008 | Johnson | B65D 45/28 220/318 |
| 2018/0327156 | A1 * | 11/2018 | Gupta | B65D 81/3876 |

* cited by examiner

*Primary Examiner* — Robert Poon
(74) *Attorney, Agent, or Firm* — Robert P. Michal, Esq.; Carter, DeLuca & Farell LLP

(57) ABSTRACT

A lid is secured to a food container with the aid of one or more handles that are mounted on the lid and/or the container. An elongated, flexible, flattened, stretchable strap overlies the lid and has a plurality of enlarged openings spaced apart along the strap. Two of the openings receive the one or more handles in a secured position.

8 Claims, 3 Drawing Sheets

DEVICE FOR AND METHOD OF SECURING A LID TO A FOOD CONTAINER

RELATED CASES

This application claims the priority benefit of U.S. provisional patent application No. 62/658,018, filed Apr. 16, 2018, whose entire disclosure is incorporated by this reference as though set forth fully herein.

BACKGROUND OF THE INVENTION

The present invention is generally directed to a food cooking and/or serving accessory, and more particularly, to a device for, and a method of, securing a lid of a food container, such as a pot, a pan, a casserole dish, a crockpot, a wok, or a like vessel, which is used for cooking and/or serving food, especially for facilitating the secure movement or transport of a full or partially-full food container, which is holding liquid and/or solid food contents, without spillage.

It is often desirable to transport a food container that has a non-locked or non-secured lid from one location, e.g., the place where the food is prepared, to another location, e.g., the place where the food will be served. These locations may be far apart and, in some cases, may involve transport by car, in which case, food spillage due to motion of the unsecured lid is a concern. In one lid securing device, a rubber band loop may be positioned over the lid, and the curved ends of the band are hooked over handles that are provided at opposite sides of the container. In another lid securing device, a cord or tape may be wound tightly around the container and the lid.

However, these known lid securing devices all suffer from the drawback that they cannot accommodate containers or lids of different shapes and sizes with handles of different shapes, locations, numbers, and sizes. Therefore, the known lid securing devices can only be used with containers, lids, and handles having specific dimensions or features, and cannot be adapted to function as a "one-size-fits-all" or universal type of lid securing device.

OBJECTS OF THE INVENTION

It is one objective of the present invention to provide a device that can effectively secure a lid to a food container to facilitate the secure movement or transport of a full or partially-full container that is holding liquid or solid food contents.

It is another objective of the present invention to provide a device for securing a lid to a container that can be used with containers of different shapes (cylindrical, rectangular, oval, lipped or non-lipped, etc.), different sizes (small, medium, large in both diameter or length and depth), and different materials (metal, plastic, ceramic, glass, etc.), It is a further objective of the present invention to provide a device for securing a lid to a container that can be used with lids of different shapes (round, rectangular, oval, convex, recessed, etc.), different materials (metal, plastic, ceramic, glass, etc.), and different sizes (small, medium, large in diameter or length).

It is yet another objective of the present invention to provide a device for securing a lid to a container that can be used with handles of different shapes (round or square knob, C-ring, recessed, stirrup, cantilever,etc.), different sizes (short or long), different materials (plastic, metal, ceramic, glass, etc.), and attached at one or more different locations on, and/or at different angles to, the container or the lid.

It is yet a further objective of the present invention to provide a lid securing device, which is versatile, reusable, heat-resistant, environmentally friendly, and readily cleanable, as well as to provide a method of securing a lid to a container, which is easy to perform.

SUMMARY OF THE INVENTION

In keeping with these objects, one feature of this invention resides, briefly stated, in a device for, and a method of, securing a lid to a food container with the aid of one or more handles that are mounted on the lid and/or the container. An elongated, flexible, flattened, stretchable strap overlies the lid and has a plurality of enlarged openings spaced apart along the strap. Two of the openings receive the one or more handles in a secured position. The strap serves as a "one-size-fits-all" or universal type of lid securing device that is reusable.

BRIEF DESCRIPTION OF THE FIGURES

The accompanying figures, where like reference numerals refer to identical or functionally similar components throughout the separate views, together with the detailed description below, are incorporated in and form part of the specification, and serve to further illustrate embodiments of concepts that include the claimed invention, and explain various principles and advantages of those embodiments.

DETAILED DESCRIPTION

Figure 1:
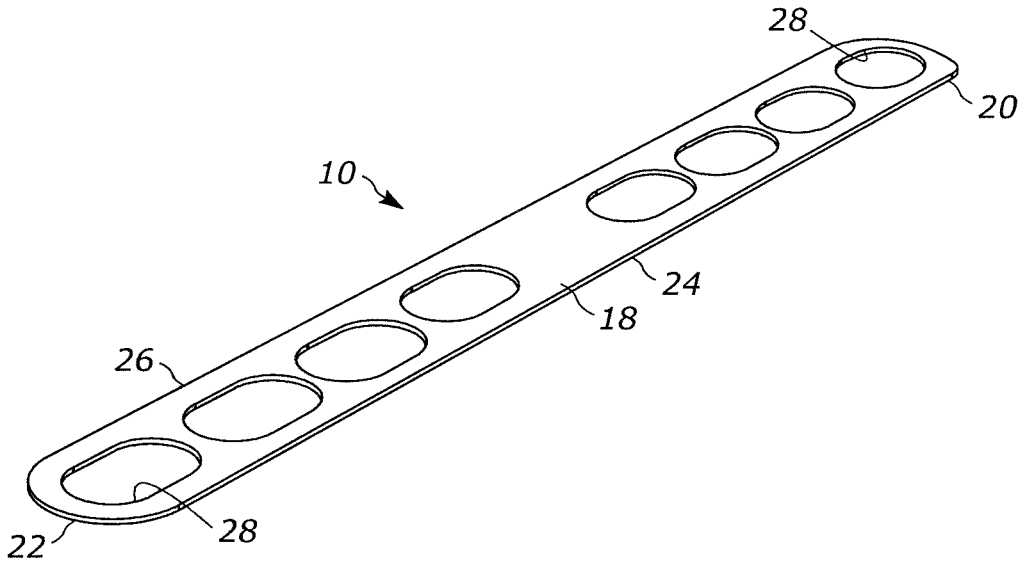
FIG. 1 is an overhead perspective view of a lid securing device in accordance with this disclosure.
Figure 2:
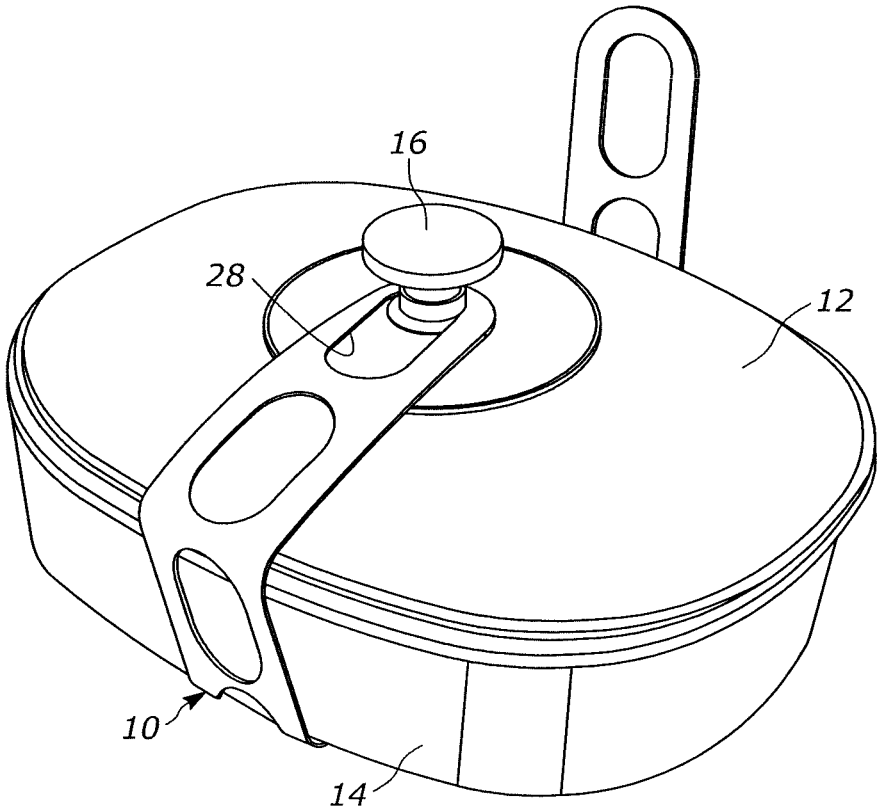
FIG. 2 is an overhead perspective view of a lid while it is being secured to a representative food container with the device of FIG. 1.
Figure 3:
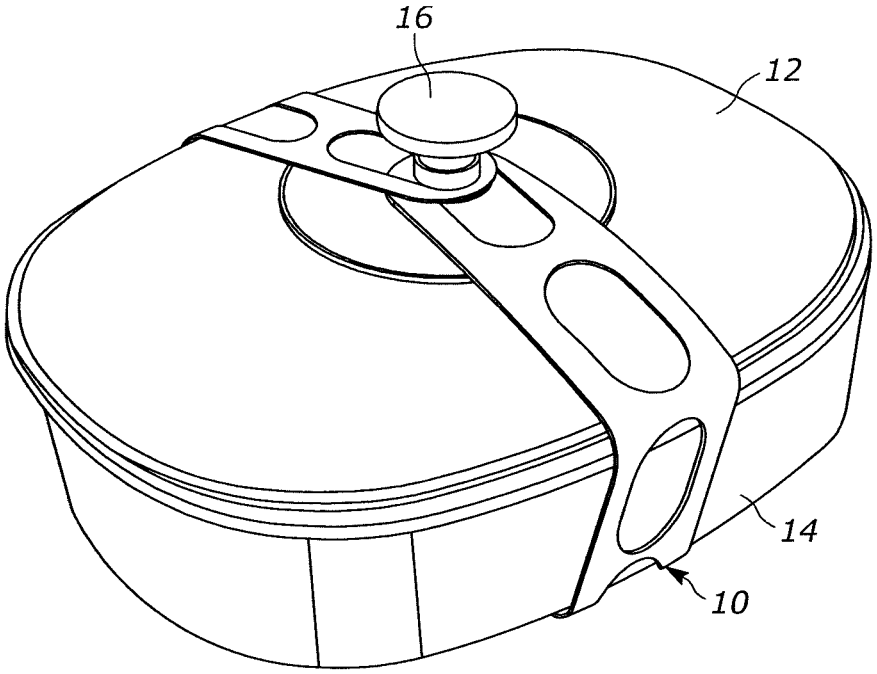
FIG. 3 is an overhead perspective view of the lid and container of FIG. 2 after the lid has been secured with the device of FIG. 1.

Referring now to FIGS. 1-3 of the drawings, reference numeral 10 generally identifies a device for securing a lid 12 to a food container 14 with the aid of a handle, such as lid handle 16. As best seen in FIG. 1, the device 10 comprises an elongated strap 18 having a length that extends between opposite end portions 20, 22 along a longitudinal direction, and a width extending in a transverse direction across the longitudinal direction between opposite peripheral longitudinal side edges 24, 26. The strap 18 is flattened and has generally planar, upper and lower surfaces that are spaced apart by a thickness in a normal direction perpendicular to the longitudinal and transverse directions. Although the strap 18 may come in different lengths, widths, and thicknesses, in one preferred embodiment, the strap is about twenty inches in length, about two inches in width, and about one-eighth inch in thickness, and may come in different colors.

Advantageously, the strap 18 is constituted of a flexible material so that it can be closely and conformingly wrapped around the lid 12 and/or the container 14, as shown in FIGS. 2-3, and is also constituted of a stretchable material so that the strap 18 may be stretched along the longitudinal direction to increase the length of the strap 18. In a preferred embodiment, the strap 18 is formed of a food-grade, elastic material, such as silicone, which is also heat-resistant, readily cleanable, and environmentally friendly.

The strap 18 also has a plurality of enlarged openings 28 spaced apart, and arranged in a row, along the longitudinal direction. Each enlarged opening 28 extends entirely through the thickness of the strap 18 in the normal direction between the upper and lower surfaces of the strap 18. At least one enlarged opening 28 is located at one of the end portions 20 of the strap 18, and at least one other enlarged opening 28 is located at the other of the end portions 22 of the strap 18.

As shown in FIG. 1, there are eight enlarged openings 28 arranged equidistantly apart in a single row, each enlarged opening 28 having an elliptical shape, and each enlarged opening 28 extending transversely for a distance that exceeds about 50% of the width of the strap 18. It will be expressly understood that the embodiment illustrated in FIG. 1 is merely exemplificative and is not intended to be limiting, but that more or less than eight openings 28 may be provided, that the openings 28 need not be equidistantly arranged or in a single row, that each opening 28 may have a non-elliptical shape, (i.e., circular or rectangular, etc.), and that each opening 28 may extend transversely more or less than 50% of the width of the strap 18.

As described above, the lid securing device 10 may be used to secure many different types of lids to many different types of food containers with the aid of many different types of handles, which may be mounted on the lid and/or on the container. For example, as shown in FIGS. 2-3, the food container 14 is relatively shallow in height; the food container 14 and its lid 12 are generally elliptical in shape, as seen from above; the lid handle 16 is a raised, round knob mounted centrally on the lid 12, and there are no container handles directly on the container 14. In this case, a selected one of the openings 28, for example, the last opening 28 in the row at the outer end of the end portion 22, is received by, and is hooked over, the lid handle 16, and the strap 18 is then wrapped underneath and around the container 14 until the opposite end portion 20 overlies the lid 12. Thereupon, another selected one of the openings 28, for example, the last opening 28 in the row at the outer end of the end portion 20, is received by, and is hooked over, the same lid handle 16.

During this procedure, the strap 18 may be stretched to insure that two of the openings 28 simultaneously receive the lid handle 16, and that the strap 18 is tensioned to exert a downward pressure to press the lid 12 against a mouth of the container 14. It will he understood that the two openings 28 need not be the last ones in the row at the outer ends of the end portions 20, 22, because the openings 28 that are selected will depend upon the size of the container 14 and the lid 12. A smaller container 14 will employ one of the openings 28 in the middle of the row since the strap 18 need not be so long to exert pressure against the lid. Thus, the device 10 is adjustable to accommodate containers, lids, and handles of different sizes and types.

Figure 4:
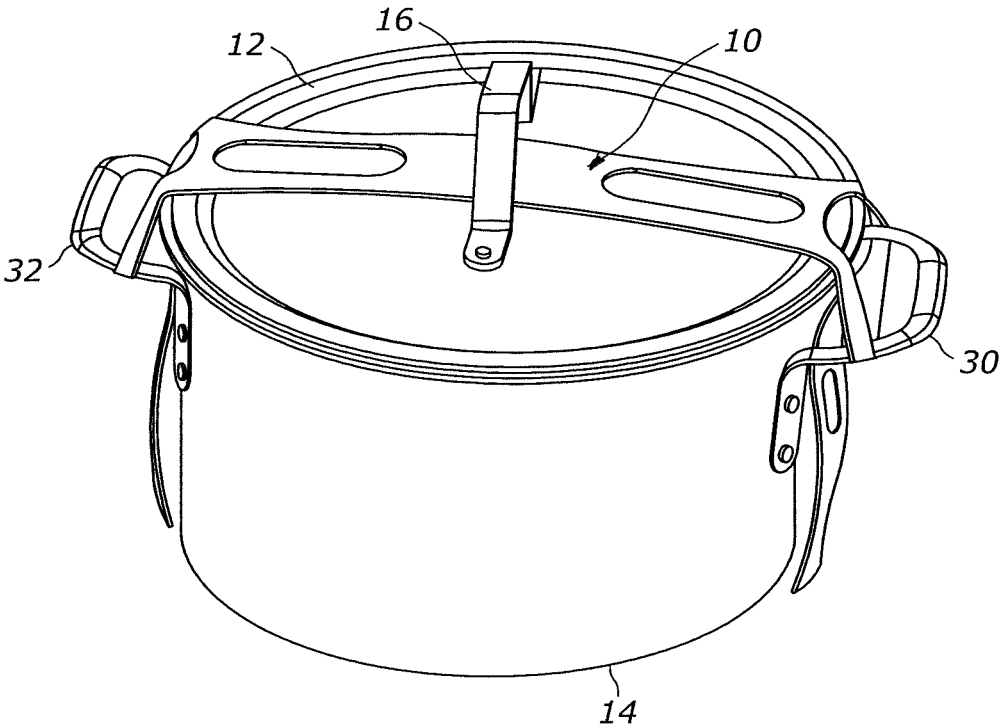
FIG. 4 is an overhead perspective view of a different lid and container after being secured by the device of FIG. 1.

In another variation, and example of versatility, as shown in FIG. 4, the food container 14 is relatively deep in height; the food container 14 and its lid 12 are generally circular in shape, as seen from above; the lid handle 16 has a raised C-shape and is mounted centrally on the lid 12, and, in addition, another pair of C-shaped container handles 30, 32 are mounted at, and extend outwardly from, opposite sides of the container 14. In this case, a selected one of the openings 28, for example, the last opening 28 in the row at the outer end of the end portion 22, is received by, and is hooked over, the container handle 30, and the strap 18 is then routed underneath and through the lid handle 16 until the opposite end portion 20 overlies the lid 12. Thereupon, another selected one of the openings 28, for example, the last opening 28 in the row at the outer end of the end portion 20, is received by, and is hooked over, the opposite container handle 32.

During this procedure, the strap 18 may he stretched to insure that two of the openings 28 respectively receive the container handles 30, 32, and that the strap 18 is tensioned to exert a downward pressure to press the lid 12 against the mouth of the container 14. It will be understood that the two openings 2$ need not be the last ones in the row at the outer ends of the end portions 20, 22, because the openings 28 that are selected will depend upon the size of the container 14 and the lid 12. A smaller container 14 will employ one of the openings 28 in the middle of the row since the strap 18 need not be so long to exert pressure against the lid. Thus, the device 10 is adjustable to accommodate containers, lids, and handles of different sizes and types.

Figure 5:
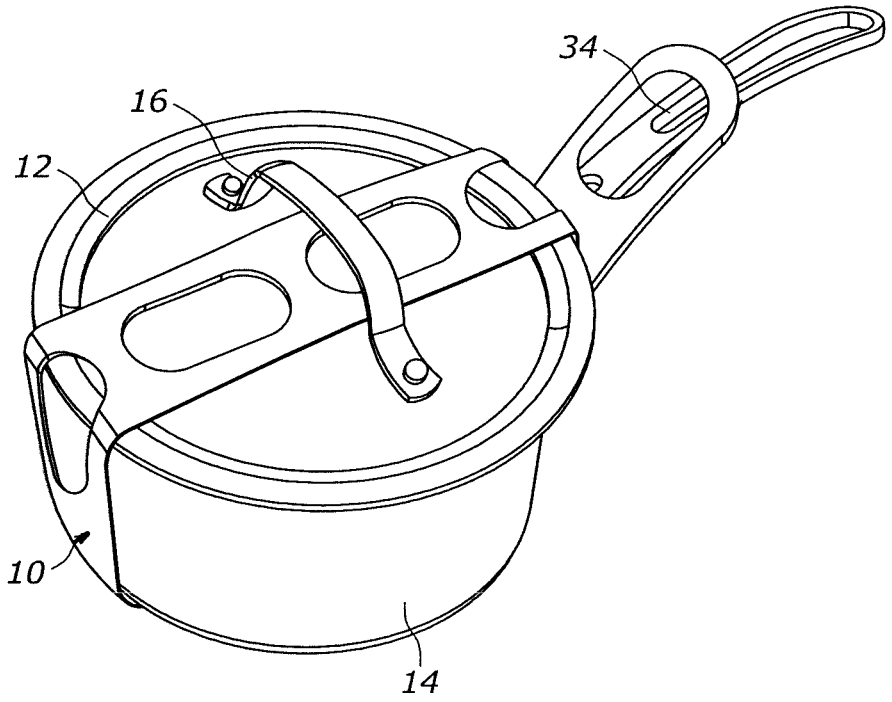
FIG. 5 is an overhead perspective view of still another different lid and container after being secured by the device of FIG. 1.

In still another variation, and further example of versatility, as shown in FIG. 5, the food container 14 is relatively deep in height; the food container 14 and its lid 12 are generally circular in shape, as seen from above; the lid handle 16 has a raised C-shape and is mounted centrally on the lid 12, and, in addition, a single, long container handle 34 is mounted at, and extends outwardly from, one side of the container 14. In this case, a selected one of the openings 28, for example, the last opening 28 in the row at the outer end of the end portion 22, is received by, and is hooked over, the container handle 34, and the strap 18 is then routed underneath and through the lid handle 16 until the opposite end portion 20 overlies the lid 12, after which the strap 18 is wrapped underneath and around the container 14. Thereupon, another selected one of the openings 28, for example, the last opening 28 in the row at the outer end of the end portion 20, is received by, and is hooked over, the same container handle 34.

During this procedure, the strap 18 may be stretched to insure that two of the openings 28 simultaneously receive the same container handle 34, and that the strap 18 is tensioned to exert a downward pressure to press the lid 12 against the mouth of the container 14. It will be understood that the two openings 28 need not be the last ones in the row at the outer ends of the end portions 20, 22, because the openings 28 that are selected will depend upon the size of the container 14 and the lid 12. A smaller container 14 and a shorter container handle 34 will employ one of the openings 28 in the middle of the row since the strap 18 need not be so long to exert pressure against the lid. Thus, the device 10 is adjustable to accommodate containers, lids, and handles of different sizes and types.

It will be understood that each of the components described above, or two or more together, also may find a useful application in other types of constructions differing from the types described above.

While the invention has been illustrated and described as embodied in a device for and a method of securing a lid to a food container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. In combination:

a food container having a mouth;

a lid that covers the mouth of the container;

a handle on the lid; and a device securing the lid to the container in a secured position, the device including:

an elongated strap having a length that extends between opposite end portions along a longitudinal direction, the strap being constituted of a flexible material that generally conforms to and overlies the lid when the lid is secured to the container in the secured position, and the strap being flattened and having generally planar, upper, and lower surfaces that are spaced apart in a normal direction perpendicular to the longitudinal direction;

the elongated strap includes a first end portion, a central portion, and a second end portion; and a plurality of enlarged openings spaced apart along the strap along the longitudinal direction, each enlarged opening extending entirely through the strap in the normal direction between the upper and lower surfaces of the strap, and each enlarged opening being configured to receive the handle in the secured position, wherein when the container is in the secured position the second end portion is substantially superposed over the first end portion.

2. The combination of claim 1, wherein the first end portion and the second end portion have openings disposed proximally to their respective ends.

3. The combination of claim 1, wherein the central portion of the elongated strap includes a plurality of openings.

4. The combination of claim 1, wherein the central portion of the elongated strap extends along a lower exterior surface of the food container.

5. In combination:

a food container having a mouth;

a lid that covers the mouth of the container;

a handle mounted on the lid; and a device securing the lid to the container in a secured position using the handle on the lid, the device including:

an elongated strap having a length that extends between opposite end portions along a longitudinal direction, the strap being constituted of a flexible material that generally conforms to and overlies the lid when the lid is secured to the container in the secured position, and the strap being flattened and having generally planar, upper and lower surfaces that are spaced apart in a normal direction perpendicular to the longitudinal direction; and a plurality of enlarged openings spaced apart along the strap along the longitudinal direction, each enlarged opening extending entirely through the strap in the normal direction between the upper and lower surfaces of the strap, and each enlarged opening being configured to receive the handle in the secured position, and wherein two of the enlarged openings both receive the handle on the lid in the secured position, wherein the lid is pressed snugly against the mouth by the strap that overlies the lid in the secured position, and wherein a central portion of the elongated strap extends along a lower exterior surface of the food container.

6. A method of securing a lid to a food container with the aid of a handle, the method comprising:

configuring the food container with a mouth;

covering the mouth of the container with the lid;

providing the handle on the lid;

providing a lid securing device with an elongated strap having a length that extends between opposite end portions along a longitudinal direction, the strap being constituted of a flexible material, and the strap being flattened and having generally planar, upper and lower surfaces that are spaced apart in a normal direction perpendicular to the longitudinal direction; and with a plurality of enlarged openings spaced apart along the strap along the longitudinal direction, each enlarged opening extending entirely through the strap in the normal direction between the upper and lower surfaces of the strap;

receiving the handle in one of the enlarged openings; and overlying the lid with the strap to press the lid snugly against the mouth of the container in a secured position, wherein a central portion of the elongated strap extends along a lower exterior surface of the food container.

7. The method of claim 6, wherein the handle is mounted on the lid, and wherein two of the enlarged openings both receive the handle in the secured position, and wherein the lid is pressed snugly against the mouth by the strap that overlies the lid in the seemed position.

8. The method of claim 6, and forming the strap of a stretchable material, and stretching the strap during overlying the lid.

* * * * *